US005983791A

United States Patent [19]

Wall et al.

[11] Patent Number: 5,983,791

[45] Date of Patent: Nov. 16, 1999

[54] END-SEAL CARRIER ASSEMBLY

[75] Inventors: Robert Wall, Prospect Park; Clifford Volpe, Mahwah, both of N.J.

[73] Assignee: Varn Products Company, Inc., Oakland, N.J.

[21] Appl. No.: 09/116,699

[22] Filed: Jul. 16, 1998

[51] Int. Cl.[6] ..... B41L 23/00

[52] U.S. Cl. ..... 101/148; 101/350.1; 101/363

[58] Field of Search ..... 101/147, 148, 101/204, 207, 208, 210, 340, 347, 350.1, 355, 356, 364, 363, 375

[56] References Cited

U.S. PATENT DOCUMENTS

| | | | |
|---|---|---|---|
| 4,945,832 | 8/1990 | Odom | 101/350.6 |
| 5,182,989 | 2/1993 | D'Heureuse et al. | 101/148 |
| 5,492,058 | 2/1996 | Greive | 101/148 |

*Primary Examiner*—Edgar Burr
*Assistant Examiner*—Dave A Ghatt
*Attorney, Agent, or Firm*—Cummings & Lockwood

[57] ABSTRACT

An improved end-seal carrier assembly for supporting a seal in a seal-type continuous dampener. The seal is supported by a backing plate and pressed against the ends of the dampener's rollers. A carrier shaft is fixedly mounted to the backing plate. A shaft housing is mounted to the sideframe and has a hole extending longitudinally there through into which the shaft is mounted so to rotationally and longitudinally translate with respect to the sideframe. A coil spring is wound about a portion of the carrier shaft and has a first spring end operatively engaging the backing plate and a second spring end operatively engaging the shaft housing. The coil spring is configured to induce both a compressive and torsional bias between the backing plate and the sideframe. The shaft housing is rotatable for winding the coil spring and thereby establishing the torsional bias.

25 Claims, 6 Drawing Sheets

END-SEAL CARRIER ASSEMBLY

BACKGROUND OF THE INVENTION

1. Field of the Invention

The subject invention relates generally to dampeners on offset lithographic printing presses, and, more particularly, to improved end-seal carriers on seal-type continuous dampeners.

2. Background of the Related Art

On a printing press utilizing the off-set lithographic method of printing there is typically required a dampener for applying dampening solution to a printing plate carried on a plate cylinder to ensure that the non-image area of the plate, and consequently the non-image area of the printed sheet, is kept clear of ink. An example of a dampener used on such printing presses is that disclosed in U.S. Pat. No. 4,455,938 (the '938 patent) to J. Loudon entitled DAMPENING APPARATUS FOR LITHOGRAPHIC PRESS, the disclosure of which is incorporated by reference. Dampeners represented by the '938 patent are described generally in the art as seal-type continuous dampeners.

The dampener apparatus described in the '938 patent essentially includes a form roller, a metering roller positioned parallel to and in contact with the form roller, and a set of side frames between which the rollers are rotationally supported. A V-shaped gap is formed above the line of contact between the form roller and metering roller. During printing operations the form roller is urged against the printing plate so as to apply dampening solution thereto.

Mounted to each side frame is an end-seal carrier. Each end-seal carrier is positioned proximate the point of contact between the form roller and metering roller for urging a pair of TEFLON end-seals against each end face of the form roller and against the outer surface each metering roller. In this position the seals 'cap' the ends of the V-shaped gap forming a reservoir for the storage of fountain solution. As the rollers rotate, the seals wear so as to conform to the contour of the rollers that they contact, thereby creating a leak-proof fit between the seals and the rollers. Each end-seal carrier functions identically to, but is symmetrically opposite the other end-seal carrier to accommodate the rollers' configuration.

Considering only one end-seal carrier assembly, to properly urge a seal against the end of the form roller and the outside diameter of the metering roller, the end-seal carrier includes a backing plate which supports the seal. Three springs work in conjunction to apply the proper resultant force vector to urge the seal against the rollers. A compression spring is oriented normally to the backing plate and fits between the sideframe and backing plate. The compression spring biases the seal against the end face of the form roller. A torsion spring is attached to the backing plate just above the seal and urges the seal downward against a bend in the backing plate and the outside diameter of the metering roller. An extension spring is attached between a lower portion of the backing plate and a tab protruding from the side frame to under the metering roller, thereby urging the bottom portion of the seal toward the line of contact between the form roller and the metering roller. Because of the construction and spring arrangement of the prior art end-seal carrier described herein above, it is not readily removable from the sideframe of the dampener. In fact, the entire dampener must be disassembled from the printing press in order to remove the prior art end-seal carrier.

Although the above described end-seal carrier assembly has been found to function satisfactorily for the dampener disclosed in the '938 patent, there are a number of disadvantages associated with it that have, for example, limited further advancements in seal-type continuous dampeners. One such disadvantage is the necessity in the prior art configuration to include a lower extension spring to urge the lower portion of the backing plate, and consequently the lower portion of the seal, toward the line of contact between the form roller and the metering roller.

Further disadvantages include the need to continually clean the extension spring since its location assures that it is constantly subjected to becoming fouled by ink, paper dust, and offset powder. In addition, since the end-seal carrier cannot be readily removed from the dampener, it is particularly difficult to configure a dampener based on the '938 patent to fit a large printing press in that such a press requires removable rollers and the end-seal carriers obstruct such roller removal. Yet another disadvantage of the prior art end-seal carrier is the lack of flexibility in configuring the profile of the sideframes of the dampener since the spring tabs must be attached to the sideframes and located immediately beneath the metering roller.

SUMMARY OF THE INVENTION

The subject invention is directed to an improved end-seal carrier assembly for supporting a seal in a dampener having a form roller and a metering roller rotationally supported between a pair of sideframes. The assembly includes a backing plate operatively configured to support the seal adjacent the ends of the form roller and metering roller. A carrier shaft defining a shaft axis has a first shaft end fixedly mounted to the backing plate and a second shaft end operatively mounted to one of the sideframes so that the carrier shaft rotationally and longitudinally translates with respect to the sideframe. In a preferred embodiment coil spring is wound about a portion of the carrier shaft and has a first spring end operatively engaging the backing plate and a second spring end operatively engaging the sideframe. The coil spring induces both a compressive and torsional bias between said backing plate and the sideframe.

The carrier shaft preferably includes a skirt made integral with and depending from the first shaft end, the skirt at least partially enclosing the coil spring. A shaft support is operatively mounted to the sideframe and has a hole extending longitudinally there through into which the second shaft end is mounted so to rotationally and longitudinally translate with respect to the sideframe. In a preferred embodiment, the shaft support includes a keyed portion which engages with a mating keyed portion of the sideframe. The keyed portions are configured so the shaft support is rotationally translatable about its axis and configured for consistent positional relation with respect to the sideframes. The aforementioned coil spring is preferably wound about and guided by a portion of said carrier shaft between said backing plate and the sideframe.

The shaft support preferably includes a cowl ring made integral with and depending from the shaft support. The cowl ring at least partially envelopes the skirt and is in bearing contact relationship with the skirt, thereby providing support for the first shaft end.

There are significant advantages in utilizing an end-seal carrier assembly of the type disclosed herein in a dampening system of the type disclosed in the '938 patent. Most notable is the elimination of the need for the extension spring from the lower portion of backing plate. This change alone provides several substantial advantages over the prior art end-seal carrier assembly including, but not limited to, eliminating the problem of having to continually clean the extension spring. In addition, the improved end-seal carrier assembly is readily removable from the dampener sideframes, thereby making it possible for seal-type continuous dampeners made in accordance with the teachings of the '938 patent to include removable rollers. Also, the improved end-seal carrier assembly allows more flexibility in configuring the profile of the sideframes of seal-type continuous dampeners.

Further features of the improved end-seal carrier assembly will become more readily apparent from the following detailed description taken in conjunction with the drawings.

BRIEF DESCRIPTION OF THE DRAWINGS

So that those of ordinary skill in the art to which the subject invention appertains will more readily understand how to make and use the improved end-seal carrier assembly described herein, preferred embodiments of the invention will be described in detail below with reference to the drawings wherein.

DETAILED DESCRIPTION OF THE PREFERRED EMBODIMENTS

Figure 1:
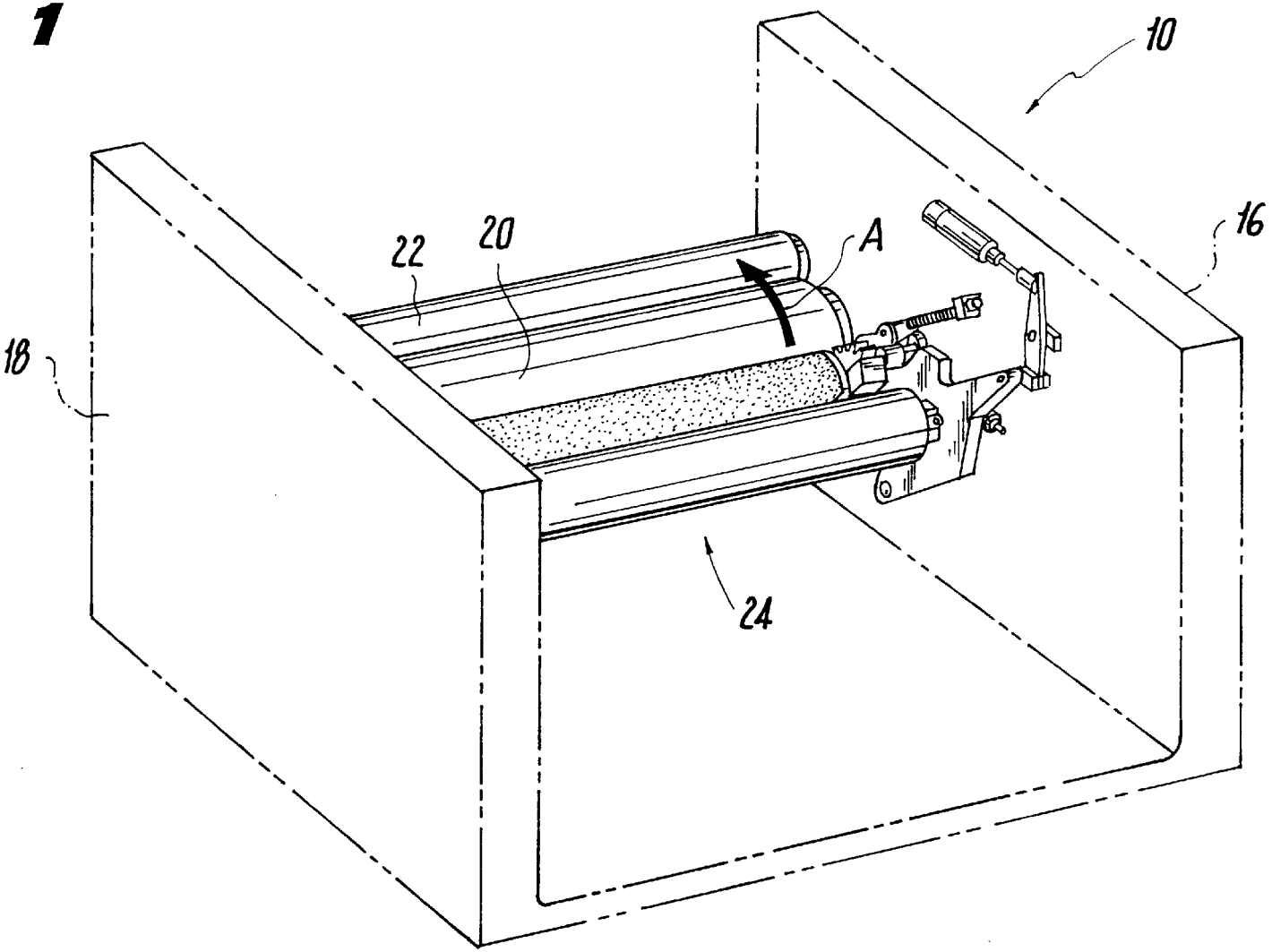
FIG. 1 is a perspective view of a printing press including a seal-type continuous dampener having improved end-seal carrier assemblies made in accordance with a preferred embodiment of the subject invention.

Referring now to the drawings wherein like reference numerals identify the same or similar structural elements of the subject invention, there is illustrated in FIG. 1 a printing press designated generally by 10. Printing press 10 is of the type used for offset lithographic printing and is shown greatly simplified to ease in illustrating the relationship between a printing press and the present invention. Various essential components of the printing press, e.g., blanket cylinder, impression cylinder, inking rollers, ink roller hangers, paper handling mechanisms, etc., have not been shown to facilitate describing the subject invention.

Printing press 10 includes a set of side frames 16 and 18. Side frame 16 is also known as the gear side frame and, as the name suggests, is the side frame to which a gear train (not shown) is mounted for driving the various cylinders, rollers, and other mechanisms of printing press 10. Side frame 18 is also known as the operator side frame and, as the name suggests, is the side from which the operator controls the printing press. References made herein below to "operator side" or "gear side" components are meant to indicate the side frame to which the components are attached or most proximate. Bridging side frames 16 and 18 is a plate cylinder 20, an ink form roller 22, and a dampener 24. As noted above, not all components have been depicted in FIG. 1 so, for example, ink form roller 22 is only representative of the entire ink train which may include as many as twenty rollers and an ink ducting system.

During printing operations, plate cylinder 20 rotates in the direction indicated by arrow 'A' and ink roller 22 and dampener 24 contact and rotate in synchronous relation with plate cylinder 20. Therefore, dampener 24 pre-wets the non-image areas of a plate 21 (See FIG. 5) attached to plate cylinder 20 and ink roller 22 applies ink to the image areas of the plate 21. Thereafter, the image is transferred to the blanket cylinder (not shown) and then the paper. Several printing assemblies as described above can be arranged in series allowing multiple color printing in one pass.

Dampener 24 is a seal-type continuous dampener as described in U.S. Pat. No. 4,455,938 (the '938 patent) to Loudon. Note that although the descriptions provided below pertain to select gear side components of dampener 24, it should be readily apparent to those skilled in the art that there are generally corresponding components configured for the operator side. These corresponding components have not been described since they operate in the same manner as those on the gear side of the press that are to be described herein below.

Figure 2:
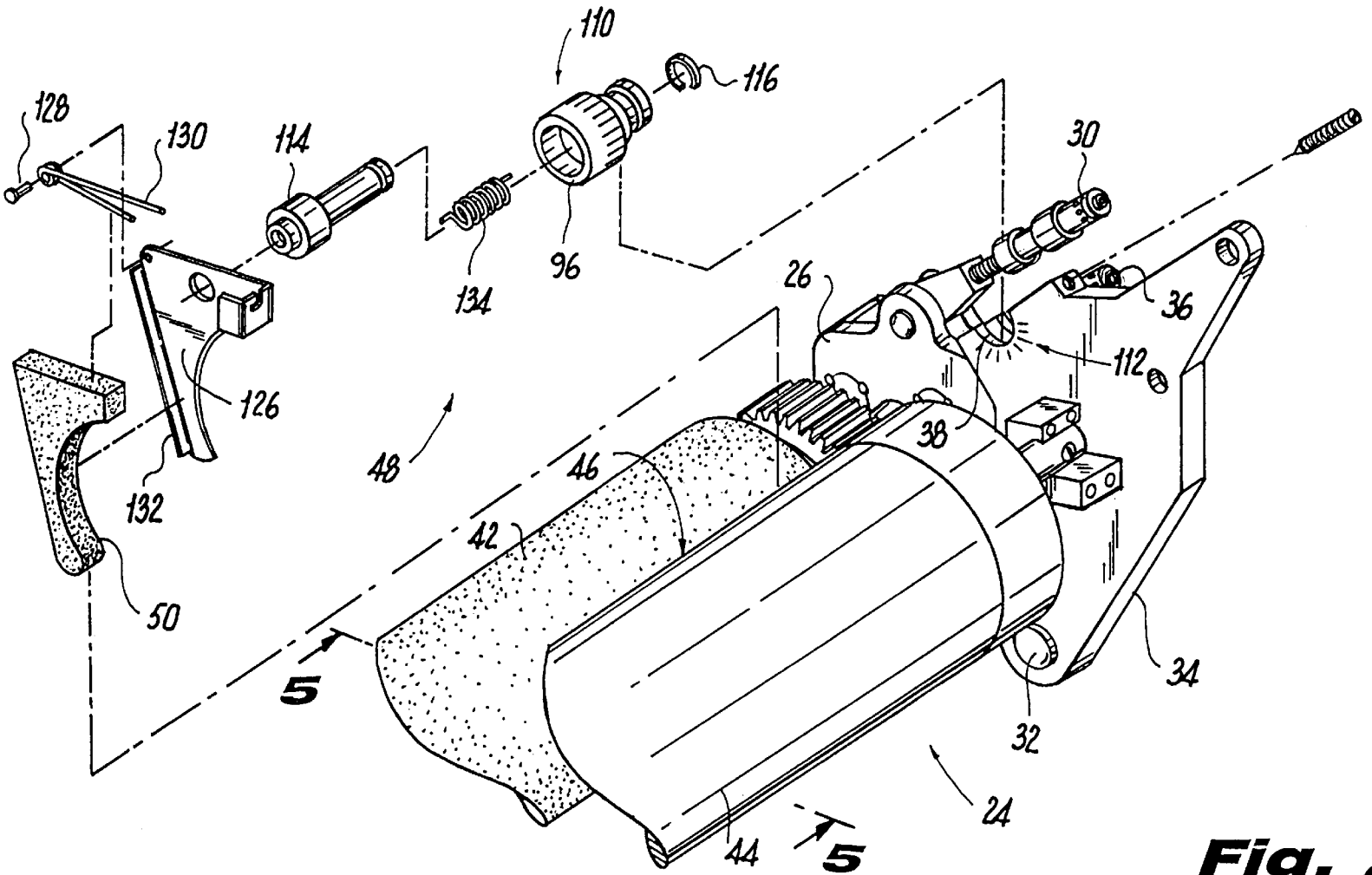
FIG. 2 is a perspective view of a seal-type continuous dampener including an improved end-seal carrier assembly made in accordance with a preferred embodiment of the subject invention with component parts thereof separated from one another to assist in better understanding the subject invention.
Figure 5:
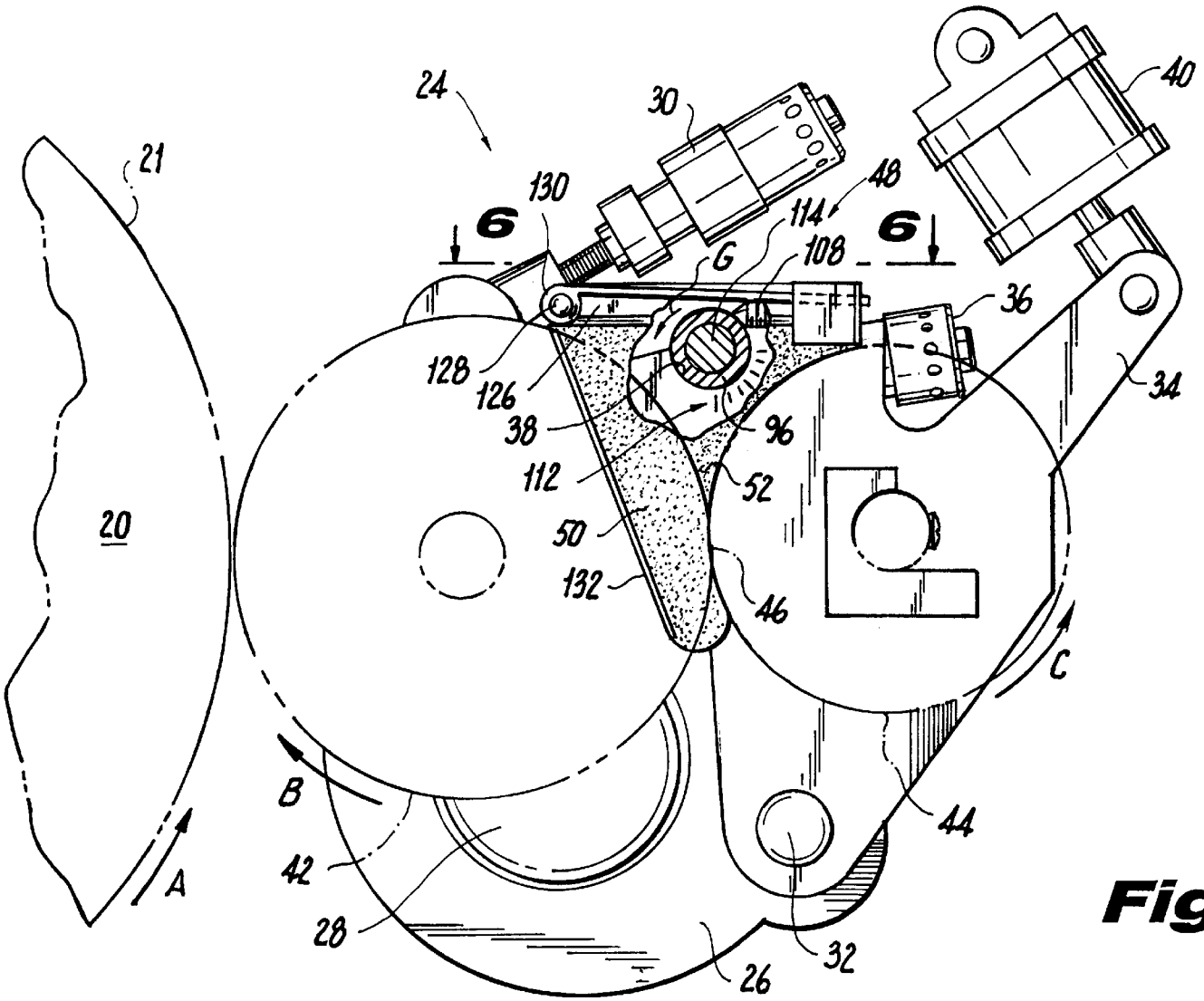
FIG. 5 is an elevational view in cross-section, taken along line 5—5 found in FIG. 2, of a seal-type continuous dampener including the improved end-seal carrier assembly.

Referring now to FIGS. 2 and 5, dampener 24 includes a main side frame 26 having its lower end pivotally mounted to bearing housing 28 which is in turn attached to gear side frame 16. A first adjustment mechanism 30 attaches the upper end of main frame 26 to gear side frame 16. A pin 32 is attached to main frame 26. A subframe 34 has its lower end pivotally mounted to pin 32. Subframe 34 is made adjustable to main frame 26 with a second adjustment mechanism 36. A semi-circular keyed shoulder 38 is machined into subframe 34. Dampener 24 is brought into and out of contact with plate cylinder 20 by a pneumatic cylinder 40.

A form roller 42 is mounted to main frame 26 for rotation about its axis. Form roller 42 has an ink receptive compressible surface which is pressed against plate cylinder 20 during printing operations. A metering roller 44 is mounted to subframe 34 for rotation about its axis. Metering roller 44 is pressed against form roller 42 with second adjustment mechanism 36. When both the gear side second adjustment mechanism 36 and operator side adjustment mechanism (not shown) are properly adjusted, an even line of contact is formed between metering roller 44 and form roller 42. Rollers 42 and 44 rotate in a direction which results in the formation of an inward nip 46—defined as a zone near the line of contact between two rotating rollers toward which the roller surfaces approach. Arrows 'B' and 'C' indicate, respectively, the direction of rotation of form roller 42 and metering roller 44 during printing operations.

An improved end-seal carrier assembly 48, which will be described in greater detail herein below, is mounted to the semi-circular keyed shoulder 38 of subframe 34. A seal 50 made of virgin TEFLON is pressed against the end face of form roller 42 and the outside diameter of metering roller 44. A solution trough 52 is created between form roller 42, metering roller 44, gear side seal 50, and an operator side seal (not shown). Dampening solution for wetting the plate 21 is maintained in trough 52 by a device such as that described in U.S. patent application Ser. No. 09/017,794 to Krzyzak et al., the disclosure of which is incorporated by reference in its entirety. Dampening solution is metered between form roller 42 and metering roller 44 and transferred to plate 21 on plate cylinder 20 by form roller 42.

Figure 3:
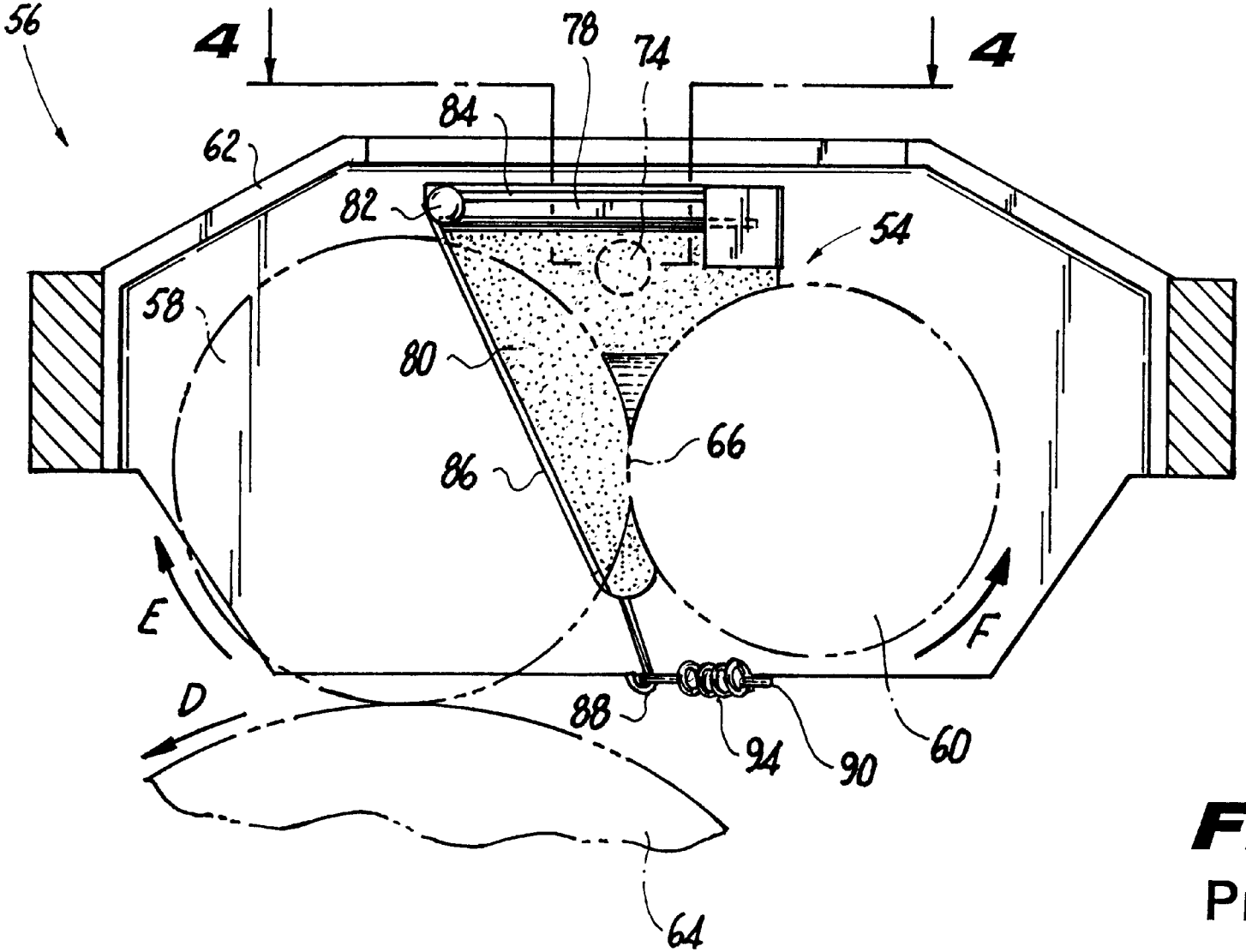
Fig. 3 Prior Art
FIG. 3 is an elevational view in cross-section of a seal-type continuous dampener including a prior art end-seal carrier assembly for maintaining a seal adjacent the ends of a form roller and a metering roller.
Figure 4:
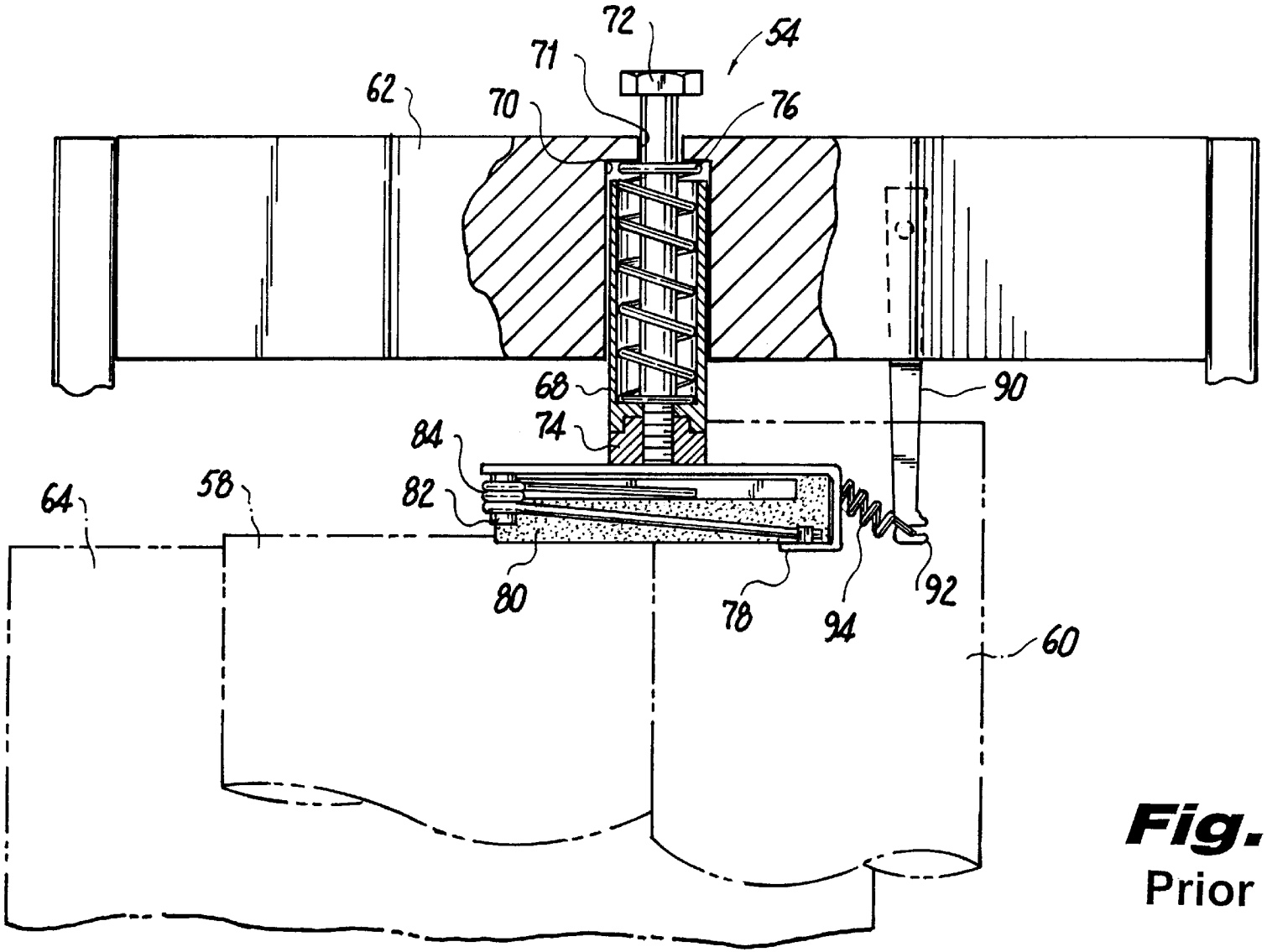
Fig. 4 Prior Art
FIG. 4 is a cross-sectional view, taken along line 4—4 of the dampener illustrated in FIG. 3, showing the relationship between the various parts of the prior art end-seal carrier assembly.

Referring to FIGS. 3 and 4 there is seen a prior art end-seal carrier assembly 54 mounted to a dampener 56 that is also based on the '938 patent. Like dampener 24, dampener 56 includes a form roller 58 and a metering roller 60 that is rotationally mounted to a sideframe 62. Side frame 62 incorporates an adjustable collar (not shown) to which metering roller 60 is mounted for adjusting the line of contact between metering roller 60 and form roller 58. Dampener 56 is mounted to a printing press (not shown) having an appropriate mechanism so that form roller 58 may be pressed against a plate cylinder 64 of the printing press during printing operations. Plate cylinder 64 rotates counter clock wise as indicated by arrow 'D' causing form roller 58 and metering roller 60 to rotate as, respectively, indicated by arrows 'E' and 'F' so that an inward nip 66 is formed there between.

Prior art end-seal carrier assembly 54 includes a guide tube 68 having a closed end with a hole extending there through. Guide tube 68 slidingly fits within a counter bore 70 of hole 71 in sideframe 62. A shoulder bolt 72 extends from outside of sideframe 62, through hole 71 and the hole extending through the base of guide tube 68, and threads into a threaded rivet 74. Guide tube 68 is captured between shoulder bolt 72 and threaded rivet 74. A compression spring 76 fits between the counter bore 70 and the closed end of guide tube 68, thereby biasing guide tube 68 to extend out of counter bore 70 away from sideframe 62. Threaded rivet 74 is swaged to a backing plate 78 which carries a seal 80. Backing plate 78 includes a shoulder rivet 82 for mounting a torsion spring 84 thereto and a bent portion 86 against which seal 80 rests. A hook 88 is formed in the base of backing plate 78. A tab 90 having a hooked end 92 is secured to the bottom of sideframe 62 beneath metering roller 60. An extension spring 94 is mounted between plate hook 88 and tab hook 92.

With continued reference to FIGS. 3 and 4, in operation, seal 80 is cradled between the end of form roller 58, backing plate 78, the bent portion 86 of backing plate 78, and the outside diameter of metering roller 60. Torsion spring 84 biases seal 80 downwardly. Extension spring 94 provides a further bias pulling the lower portion of backing plate 78, and thereby seal 80, toward inward nip 66 between form roller 58 and metering rollers 60. Compression spring 76 provides yet another bias pressing seal 80 against the end of form roller 58. The overall effect of the three biasing forces provided by torsion spring 84, extension spring 94, and compression spring 76 is a V-shaped seal between seal 80, the end of form roller 58, and the outside diameter of metering roller 60.

Figure 6:
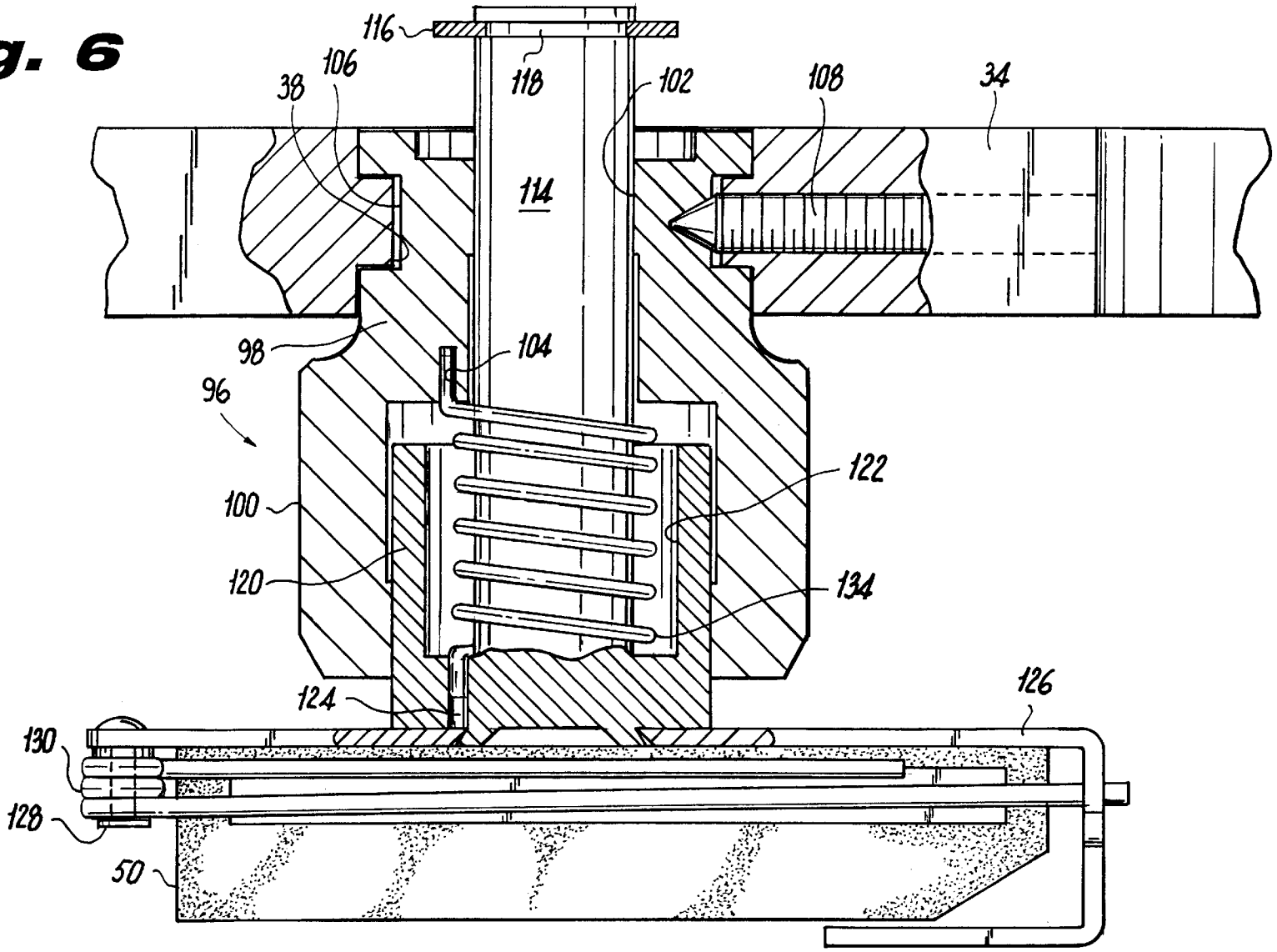
FIG. 6 is a cross-sectional view, taken along line 6—6 of the dampener illustrated in FIG. 5, showing the relationship between the various parts of the improved end-seal carrier assembly made in accordance with a preferred embodiment of the subject invention.

Referring to FIGS. 2, 5, and 6, the illustrated improved end-seal carrier 48 includes a shaft housing 96 made up of a shaft support 98 and a cowl ring 100. A hole 102 extends through shaft support 98 and a blind hole 104 extends parallel thereto proximate cowl ring 100. Machined into shaft support 98 is a keyed groove 106 that mates with keyed shoulder 38 of subframe 34. A cone point set screw 108 is threaded through subframe 34 and secures shaft housing 96 in position. Two sets of evenly spaced markings, 110 and 112, extend, respectively, in an axially direction along the outside diameter of cowl ring 100 and radially from the center of semi-circular keyed shoulder 38.

A carrier shaft 114 has a first end and a second end. The second end or carrier shaft 114 is slidingly fit within hole 102 of shaft support 98. A retaining ring 116 is clipped to a groove 118 in the second end of carrier shaft 114. A skirt 120 extends from the first end of carrier shaft 114 and forms a cylindrical recess 122 thereabout. Skirt 120 slidingly fits within cowl ring 100 and is supported thereby. A hole 124 extends through the base of cylindrical recess 122. The first end of carrier shaft 114 is fixedly swaged to a substantially rigid backing plate 114. Backing plate 126 includes a shoulder rivet 128 for mounting a torsion spring 130 thereto and a bent portion 132 against which seal 50 rests. A coil spring 134 is loosely wrapped around carrier shaft 114. A first end of coil spring 134 engages with hole 124 in carrier shaft 114 and a second end of coil spring 134 engages with blind hole 104 in shaft support 98.

It is important that carrier shaft 114 is mounted to backing plate 126 in such a way that it is not allowed to rotate in relation thereto. If the mounting is to be accomplished by swaging, for example, the hole in backing plate 126 through which carrier shaft 114 is received can include notches to permit better gripping of the swaged material. This and other methods are well known by those skilled in the art. It is also important that backing plate 126 is sufficiently rigid to minimize deflection when seal 50 is pressed against form roller 42. Such may be accomplished, for example, by increasing the material thickness or adding appropriate bends.

Before being put into operation, improved end-seal carrier assembly 48 is preferrably adjusted. This is done by loosening cone point set screw 108 and rotating shaft housing 96 in the direction that coincides with the wind of coil spring 134 such that coil spring 134 tends to wind tighter around carrier shaft 114. See, for example, arrow 'G' in FIG. 5. Shaft housing 96 is rotated until a sufficient torsional bias is obtained such that the lower portion of seal 50 will seat against the outside diameter of metering roller 44 and not rotated so much that coil spring 134 locks onto carrier shaft 114. Those skilled in the art will readily recognize, based on the teachings herein, that coil spring 134 is advantageously configured to have the proper number of turns, wire thickness, and inside diameter so to satisfy the above parameters. As shaft housing 96 is rotated, the number of markings 110 and 112 that cross should be noted. After adjusting improved end-seal carrier assembly 48, cone point set screw 108 is tightened against the bottom of keyed groove 106 on shaft support 98. Thereafter, the improved end seal carrier assembly found on the operator side of the press (not shown) is adjusted approximately the same amount as improved end-seal carrier assembly 48. This may be done by rotating the end-seal carrier past the same number of markings that improved end-seal carrier assembly 48 was adjusted to.

In operation, seal 50 is cradled between the end of form roller 42, backing plate 126, bent portion 132 of backing plate 126, and the outside diameter of metering roller 44. Torsion spring 130 biases seal 50 downwardly. Coil spring 134 provides dual biasing to backing plate 126 by tending to rotate backing plate 126 such that seal 50 is pressed against the outside diameter of metering roller 44. In addition, coil spring 134 biases seal 50 against the end face of form roller 42. The overall effect of the three biasing forces provided by torsion spring 130 and coil spring 134 is a V-shaped seal between seal 50, the end of form roller 42, and the outside diameter of metering roller 44.

From the above description of a preferred embodiment, it is apparent that there are significant advantages in utilizing improved end-seal carrier assembly 48. Most notable is the elimination of the need for extension spring 94 from the lower portion of backing plate 126. This change alone provides several substantial advantages over prior art end-seal carrier assembly 54 (ref. FIG. 3). First, it has removed the problem of having to continually clean extension spring 94 as is necessary with prior art end-seal carrier assembly 54. In addition, improved end-seal carrier assembly 48 is readily removable from subframe 34, thereby making it possible for seal-type continuous dampeners made in accordance with the teachings of the '938 patent to include removable rollers. Having removable rollers is of particular importance when fitting seal-type continuous dampeners to larger format printing presses since on such larger presses it is virtually impossible because of the weight, to install a dampener of this type as one assembly. Yet another advantage of eliminating extension spring 94 is it allows more flexibility in configuring the profile of main frame 26 and subframe 34 since it is no longer necessary to locate tab 90 (cf. FIGS. 3 and 5). And yet another advantage of having simplified the removal of improved end-seal carrier assembly 48 is the ease of conducting periodic maintenance.

While the invention has been described with respect to a preferred embodiment, those skilled in the art will readily appreciate that various other changes or modifications that can be made thereto without departing from the spirit or scope of the invention as defined by the appended claims.

What is claimed is:

1. An end-seal carrier assembly comprising:

a) a backing plate operatively configured to support an end-seal;

b) a carrier shaft defining a shaft axis and having a first shaft end fixedly mounted to said backing plate and a second shaft end for operative mounting to a dampener sideframe so said carrier shaft rotationally and longitudinally translates with respect to the sideframe; and c) a coil spring having a first spring end drivingly coupled to said backing plate and a second spring end drivingly coupled to the sideframe, said coil spring inducing both a compressive and torsional bias between said backing plate and the sideframe.

2. An end-seal carrier assembly as recited in claim 1, wherein said coil spring is wound about and guided by a portion of said carrier shaft between said backing plate and the sideframe.

3. An end-seal carrier assembly as recited in claim 2, wherein said carrier shaft includes a skirt made integral with and depending from said first shaft end, said skirt at least partially enclosing said coil spring.

4. An end-seal carrier assembly as recited in claim 1, further including a shaft support mounted to the sideframe and having a hole extending longitudinally there through into which said second shaft end is mounted so to rotationally and longitudinally translate with respect to the sideframe.

5. An end-seal carrier assembly as recited in claim 4, wherein said shaft support includes a keyed portion which engages with a mating keyed portion of the sideframe, said keyed portions configured so said shaft support is rotationally translatable about its axis and configured for consistent positional relation with respect to the sideframes.

6. An end-seal carrier assembly as recited in claim 5, wherein said coil spring is wound about and guided by a portion of said carrier shaft between said backing plate and the sideframe.

7. An end-seal carrier assembly as recited in claim 6, wherein said carrier shaft includes a skirt made integral with and depending from said first shaft end, said skirt at least partially enclosing said coil spring.

8. An end-seal carrier assembly as recited in claim 7, wherein said shaft support includes a cowl ring made integral with and depending from said shaft support, said cowl ring at least partially enveloping said skirt.

9. An end-seal carrier assembly as recited in claim 8, wherein said cowl ring is in bearing contact relationship with said skirt thereby providing support for said first shaft end.

10. An end-seal carrier assembly for supporting a seal in a dampener having a form roller and a metering roller rotatably supported between sideframes, said assembly comprising:

a) a backing plate operatively configured to support the seal adjacent ends of the form roller and metering roller;

b) a carrier shaft defining a shaft axis and having a first shaft end fixedly mounted to said backing plate and a second shaft end mounted to one of the sideframes so said carrier shaft rotationally and longitudinally translates with respect to the sideframe; and c) a coil spring wound about a portion of said carrier shaft and having a first spring end said backing plate and a second spring end the sideframe, said coil spring inducing both a compressive and torsional bias between said backing plate and the sideframe.

11. An end-seal carrier assembly as recited in claim 10, wherein said carrier shaft includes a skirt made integral with and depending from said first shaft end, said skirt at least partially enclosing said coil spring.

12. An end-seal carrier assembly as recited in claim 10, further including a shaft support mounted to the sideframe and having a hole extending longitudinally there through into which said second shaft end is mounted so to rotationally and longitudinally translate with respect to the sideframe.

13. An end-seal carrier assembly as recited in claim 12, wherein said shaft support includes a keyed portion which engages with a mating keyed portion of the sideframe, said keyed portions configured so said shaft support is rotationally translatable about its axis and configured for consistent positional relation with respect to the sideframes.

14. An end-seal carrier assembly as recited in claim 13, wherein said coil spring is wound about and guided by a portion of said carrier shaft between said backing plate and the sideframe.

15. An end-seal carrier assembly as recited in claim 14, wherein said carrier shaft includes a skirt made integral with and depending from said first shaft end, said skirt at least partially enclosing said coil spring.

16. An end-seal carrier assembly as recited in claim 15, wherein said shaft support includes a cowl ring made integral with and depending from said shaft support, said cowl ring at least partially enveloping said skirt.

17. An end-seal carrier assembly as recited in claim 16, wherein said cowl ring is in bearing contact relationship with said skirt, thereby providing support for said first shaft end.

18. A dampener apparatus for a printing press comprising:

a) a set of sideframes;

b) a form roller rotatably supported by said sideframes;

c) a metering roller rotatably supported by said sideframes and in parallel relation with said form roller; and d) at least one end-seal carrier assembly operatively mounted to said sideframes for supporting a seal including:

i) a backing plate operatively configured to support the seal adjacent the ends of the form roller and metering roller;

ii) a carrier shaft defining a shaft axis and having a first shaft end fixedly mounted to said backing plate and a second shaft end mounted to one of the sideframes so said carrier shaft rotationally and longitudinally translates with respect to the sideframe; and iii) a coil spring having a first spring end drivingly coupled to said backing plate and a second spring end drivingly coupled to the sideframe, said coil spring inducing both a compressive and torsional bias between said backing plate and the sideframe.

19. An end-seal carrier assembly as recited in claim 18, wherein said carrier shaft includes a skirt made integral with and depending from said first shaft end, said skirt at least partially enclosing said coil spring.

20. An end-seal carrier assembly as recited in claim 18, further including a shaft support mounted to the sideframe and having a hole extending longitudinally there through into which said second shaft end is mounted so to rotationally and longitudinally translate with respect to the sideframe.

21. An end-seal carrier assembly as recited in claim 20, wherein said shaft support includes a keyed portion and said sideframe includes a mating keyed portion which engages with said shaft support keyed portion; said keyed portions configured so said shaft support is rotationally translatable about its axis and configured for consistent positional relation with respect to the sideframes.

22. An end-seal carrier assembly as recited in claim 21, wherein said coil spring is wound about and guided by a portion of said carrier shaft between said backing plate and the sideframe.

23. An end-seal carrier assembly as recited in claim 22, wherein said carrier shaft includes a skirt made integral with and depending from said first shaft end, said skirt at least partially enclosing said coil spring.

24. An end-seal carrier assembly as recited in claim 23, wherein said shaft support includes a cowl ring made integral with and depending from said shaft support, said cowl ring at least partially enveloping said skirt.

25. An end-seal carrier assembly as recited in claim 24, wherein said cowl ring is in bearing contact relationship with said skirt thereby providing support for said first shaft end.

* * * * *